US006564580B2

(12) United States Patent
Bowen et al.

(10) Patent No.: US 6,564,580 B2
(45) Date of Patent: May 20, 2003

(54) PROCESS FOR RECOVERING ETHANE AND HEAVIER HYDROCARBONS FROM METHANE-RICH PRESSURIZED LIQUID MIXTURE

(75) Inventors: Ronald R. Bowen, Magnolia, TX (US); Moses Minta, Sugar Land, TX (US); E. Lawrence Kimble, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/175,768

(22) Filed: Jun. 20, 2002

(65) Prior Publication Data

US 2003/0014995 A1 Jan. 23, 2003

Related U.S. Application Data

(60) Provisional application No. 60/302,123, filed on Jun. 29, 2001.

(51) Int. Cl.[7] ..... F25J 1/00
(52) U.S. Cl. ..... 62/623; 62/632
(58) Field of Search ..... 62/620, 623, 632, 62/635

(56) References Cited

U.S. PATENT DOCUMENTS

| | | | | | |
|---|---|---|---|---|---|
| 2,181,302 | A | | 11/1939 | Keith, Jr. et al. | 196/10 |
| 2,849,371 | A | | 8/1958 | Gilmore | 196/8 |
| 2,857,018 | A | | 10/1958 | Partridge et al. | 183/115 |
| 2,959,540 | A | | 11/1960 | Cahn et al. | 208/345 |
| 3,214,890 | A | | 11/1965 | Sterrett | 55/40 |
| 3,347,621 | A | | 10/1967 | Papadopoulos et al. | 23/2 |
| 3,555,837 | A | | 1/1971 | McClintock | 62/17 |
| 3,574,089 | A | | 4/1971 | Forbes | 208/101 |
| 3,633,371 | A | | 1/1972 | Davison | 62/17 |
| 4,009,097 | A | | 2/1977 | Ward | 208/342 |
| 4,072,604 | A | | 2/1978 | Ward | 208/341 |
| 4,575,387 | A | * | 3/1986 | Larue et al. | 62/632 |
| 4,693,731 | A | * | 9/1987 | Tarakad et al. | 62/632 |
| 4,738,699 | A | | 4/1988 | Apffel | 62/11 |
| 4,747,858 | A | * | 5/1988 | Gottier | 62/632 |
| 4,883,515 | A | * | 11/1989 | Mehra et al. | 62/632 |
| 5,325,673 | A | | 7/1994 | Durr et al. | 62/23 |
| 5,685,170 | A | | 11/1997 | Sorensen | 62/625 |
| 5,687,584 | A | | 11/1997 | Mehra | 62/632 |
| 5,950,453 | A | | 9/1999 | Bowen et al. | 62/612 |
| 5,956,971 | A | | 9/1999 | Cole et al. | 62/623 |
| 6,016,665 | A | | 1/2000 | Cole et al. | 62/612 |
| 6,023,942 | A | | 2/2000 | Thomas et al. | 62/613 |

* cited by examiner

*Primary Examiner*—Ronald Capossela
(74) *Attorney, Agent, or Firm*—Gary Lawson

(57) ABSTRACT

The invention is an absorption process for recovering $C_{2+}$ components from a pressurized liquid mixture comprising $C_1$ and $C_{2+}$. The pressurized liquid mixture is at least partially vaporized by heating the liquid mixture in a heat transfer means. The heat transfer means provides refrigeration to an absorption medium that is used in treating the vaporized mixture in an absorption zone. The vaporized mixture is passed to an absorption zone that produces a first stream enriched in $C_1$ and a second stream enriched in $C_{2+}$ components. The pressurized liquid mixture is preferably pressurized liquid natural gas (PLNG) having an initial pressure above about 1,724 kPa (250 psia) and an initial temperature above −112° C. (−170° F.). Before being vaporized, the pressurized liquid mixture is preferably boosted in pressure to approximately the desired operating pressure of the absorption zone.

10 Claims, 3 Drawing Sheets

PROCESS FOR RECOVERING ETHANE AND HEAVIER HYDROCARBONS FROM METHANE-RICH PRESSURIZED LIQUID MIXTURE

RELATED U.S. APPLICATION DATA

This application claims the benefit of U.S. Provisional Application No. 60/302,123, filed Jun. 29, 2001.

FIELD OF THE INVENTION

This invention relates to a process for recovering ethane and heavier hydrocarbons from pressurized liquefied gas mixture comprising methane and heavier hydrocarbons.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

The source gas for making LNG is typically obtained from a crude oil well (associated gas) or from a gas well (non-associated gas). Associated gas occurs either as free gas or as gas in solution in crude oil. Although the composition of natural gas varies widely from field to field, the typical gas contains methane ($C_1$) as a major component. The natural gas stream may also typically contain ethane ($C_2$), higher hydrocarbons ($C_{3+}$), and minor amounts of contaminants such as carbon dioxide ($CO_2$), hydrogen sulfide, nitrogen, dirt, iron sulfide, wax, and crude oil. The solubilities of the contaminants vary with temperature, pressure, and composition. At cryogenic temperatures, $CO_2$, water, other contaminants, and certain heavy molecular weight hydrocarbons can form solids, which can potentially plug flow passages in cryogenic equipment. These potential difficulties can be avoided by removing such contaminants and heavy hydrocarbons.

Commonly used processes for transporting remote gas separate the feed natural gas into its components and then liquefy only certain of these components by cooling them under pressure to produce liquefied natural gas ("LNG") and natural gas liquid ("NGL"). Both processes liquefy only a portion of a natural gas feed stream and many valuable remaining components of the gas have to be handled separately at significant expense or have to be otherwise disposed of at the remote area.

In a typical LNG process, substantially all of the hydrocarbon components in the natural gas that are heavier than propane (some butane may remain), all "condensates" (for example, pentanes and heavier molecular weight hydrocarbons) in the gas, and essentially all of the solid-forming components (such as $CO_2$ and $H_2S$) in the gas are removed before the remaining components (e.g. methane, ethane, and propane) are cooled to cryogenic temperature of about −160° C. The equipment and compressor horsepower required to achieve these temperatures are considerable, thereby making any LNG system expensive to build and operate at the producing or remote site.

In a NGL process, propane and heavier hydrocarbons are extracted from the natural gas feed stream and are cooled to a low temperature (above about −70° C.) while maintaining the cooled components at a pressure above about 100 kPa in storage. One example of a NGL process is disclosed in U.S. Pat. No. 5,325,673 in which a natural gas stream is pretreated in a scrub column in order to remove freezable (crystallizable) $C_{5+}$ components. Since NGL is maintained above −40° C. while conventional LNG is stored at temperatures of about −160° C., the storage facilities used for transporting NGL are substantially different, thereby requiring separate storage facilities for LNG and NGL which can add to overall transportation cost.

It has also been proposed to transport natural gas at temperatures above −112° C. (−170° F.) and at pressures sufficient for the liquid to be at or below its bubble point temperature. This pressurized liquid natural gas is referred to as "PLNG" to distinguish it from LNG, which is transported at near atmospheric pressure and at a temperature of about −162° C. (−260° F.). Exemplary processes for making PLNG are disclosed in U.S. Pat. No. 5,950,453 (R. R. Bowen et al.); U.S. Pat. No. 5,956,971 (E. T. Cole et al.); U.S. Pat. No. 6,016,665 (E. T. Cole et al.); and U.S. Pat. No. 6,023,942 (E. R. Thomas et al.). Because PLNG typically contains a mixture of low molecular weight hydrocarbons and other substances, the exact bubble point temperature of PLNG is a function of its composition. For most natural gas compositions, the bubble point pressure of the natural gas at temperatures above −112° C. will be above about 1,380 kPa (200 psia). One of the advantages of producing and shipping PLNG at a warmer temperature is that PLNG can contain considerably more $C_{2+}$ components than can be tolerated in most LNG applications.

Depending upon market prices for ethane, propane, butanes, and the heavier hydrocarbons, it may be economically desirable to transport the heavier products with the PLNG and to sell them as separate products. This separation of the PLNG into component products is preferably performed once the PLNG has been transported to a desired import location. A need exists for an efficient process for separating the $C_{2+}$ components from the PLNG.

SUMMARY

The invention is an absorption process for recovering $C_{2+}$ components from a pressurized liquid mixture comprising $C_1$ and $C_{2+}$. The pressurized liquid mixture is at least partially vaporized by heating the liquid mixture in a heat transfer means. The heat transfer means provides refrigeration to an absorption medium that is used in treating the vaporized mixture in an absorption zone. The vaporized mixture is passed to an absorption zone that produces a first stream enriched in $C_1$ and a second stream enriched in $C_{2+}$ components. The pressurized liquid mixture is preferably pressurized liquid natural gas (PLNG) having an initial pressure above about 1,724 kPa (250 psia) and an initial temperature above −112° C. (−170° F.). Before being vaporized, the pressurized liquid mixture is preferably boosted in pressure to approximately the desired operating pressure of the absorption zone.

BRIEF DESCRIPTION OF THE DRAWINGS

The present invention and its advantages will be better understood by referring to the following detailed description and the attached drawings.

The drawings illustrate a specific embodiment of practicing the method of this invention. The drawings are not intended to exclude from the scope of the invention other embodiments that are the result of normal and expected modifications of the specific embodiment. Most of the required subsystems such as pumps, valves, flow stream mixers, control systems, and fluid level sensors have been deleted from the drawings for the purposes of simplicity and clarity of presentation.

DETAILED DESCRIPTION OF THE INVENTION

The following description makes use of several terms often used in the industry which are defined as follows to aid the reader in understanding the invention.

"Lean oil" is a hydrocarbon liquid used as an absorption media and circulated in contact with a vaporized multi-component gas containing methane and $C_{2+}$ hydrocarbons to absorb one or more components of the multi-component gas that are heavier than methane, preferably the $C_{2+}$ hydrocarbons. The composition of the lean oil can vary depending on the temperature and pressure under which the absorption occurs and the composition of the multi-component gas. The oil may be charged to the separation process and/or it may be accumulated from the heaviest components absorbed from the gas.

"Rich oil" is a relative term since there are degrees of richness, but it is the lean oil after it has contacted the multi-component gas and has absorbed within it $C_{2+}$. The rich oil is typically denuded of the absorbed components by fractionation and becomes lean again to be recirculated.

"Natural gas" means gas used in producing PLNG, which can be gas obtained from a crude oil well (associated gas) and/or from a gas well (non-associated gas). Associated gas occurs either as free gas or as gas in solution in crude oil. Although the composition of natural gas varies widely from field to field, the typical gas contains methane ($C_1$) as a major component. The natural gas stream may also typically contain ethane ($C_2$), higher hydrocarbons ($C_{3+}$), and minor amounts of contaminants such as carbon dioxide ($CO_2$), hydrogen sulfide, nitrogen, dirt, iron sulfide, wax, and crude oil. The solubilities of the contaminants vary with temperature, pressure, and composition. If the natural gas stream contains heavy hydrocarbons that could freeze out during liquefaction or if the heavy hydrocarbons are not desired in PLNG because of compositional specifications or their value as natural gas liquids (NGLs), the heavy hydrocarbons are typically removed by a fractionation process prior to liquefaction of the natural gas to PLNG.

Figure 1:
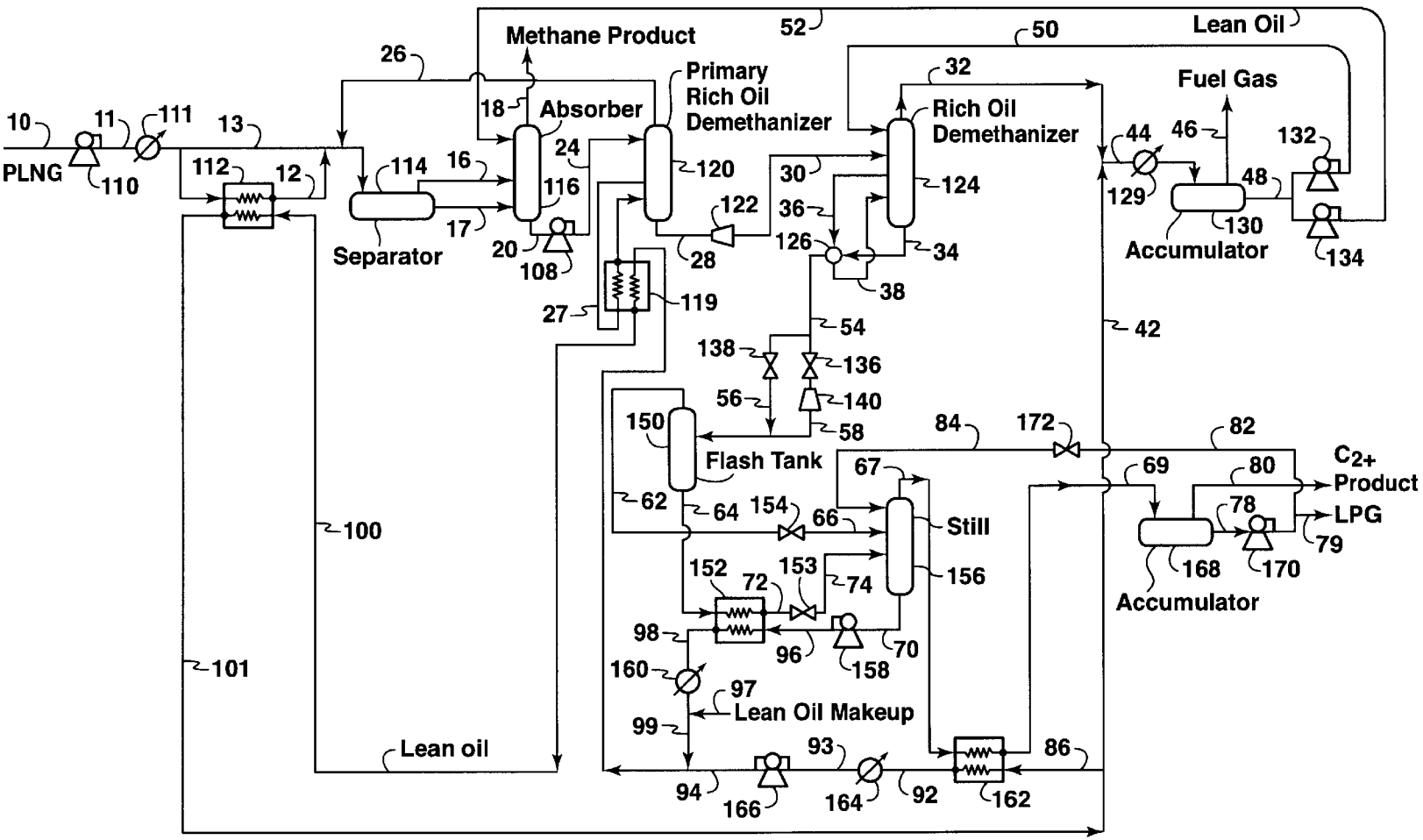
FIG. 1 is a schematic flow diagram of one embodiment of a separation process for removing ethane and heavier components from PLNG.

Referring to FIG. 1, a schematic is shown of one embodiment of practicing the process of the present invention. PLNG, preferably at a temperature above 250 psia (1723 kPa), enters the separation process through line 10 and is preferably boosted in pressure by pump 110. The pressurized liquid is preferably passed through a pre-heater 111 wherein the PLNG can be pre-heated against various materials, including environmental streams such as air, seawater, or a glycol-water mixture. The PLNG stream is preferably pre-heated by pre-heater 111 as a means of obtaining a desired feed gas temperature to absorber 116. While pre-heater 111 is optional, depending on the composition of lean oil used in the separation process, pre-heater 111 can also help reduce the potential for the freezing out of certain heavier lean oil components, if present, in the lean oil being cooled by the PLNG in heat-exchange means 112. The desired temperature of the PLNG entering the absorber 116 depends on process configuration, PLNG composition, and the lean oil composition being used in the separation process. At least a portion of PLNG stream 12 is heated by passing through a heat-exchange means 112 for vaporizing at least part of the PLNG. If the heat-exchange means 112 is a plate-fin exchanger used in the configuration shown in FIG. 1, PLNG stream 12 is preferably separated to comply with the thermal stress limitations of the exchanger. If the heat-exchange means 112 is a plate-fin exchanger used in an indirect heating configuration shown in FIG. 2, which will be described in more detail hereafter, all of the PLNG stream may be passed through the heat-exchange means 112. The thermodynamic properties of the indirect heat exchange medium used in the process (for example, ethane) can prevent potentially unacceptably high thermal stresses in the heat-exchange means 112. In FIG. 3, the u-tube heat exchange system 300 also uses an indirect heat exchange medium that can protect the heat exchangers from potentially destructive thermal stresses. The heating of the PLNG in heat-exchange means 112 cools lean oil stream 100, which is used in the separation process as described in more detail later in this description. The at least partially vaporized stream is then passed to liquid-vapor separator 114. Vapor stream 16 and liquid stream 17, if any, are passed from separator 114 to absorber 116. Also entering absorber 116, at the upper end thereof, is a lean absorber liquid stream 52, referred to herein as "lean oil." In the absorber 116, the vapor stream 16 rises to the top of absorber 116, encountering a stream of lean oil traveling downward over bubble-caps, trays, or similar separation devices. The absorber 116 operates at conditions that cause the lean oil to remove (absorb) the $C_{2+}$ components from the vapor stream 16 that enters absorber 116. The rich lean oil and condensed hydrocarbon liquids (stream 17) mix in the bottom of absorber 116 prior to being routed to a primary rich oil demethanizer 120 ("PROD") or to a rich oil demethanizer 124 ("ROD"). Although the separation process shown in FIG. 1 illustrates two demethanizer columns 120 and 124, the invention is not limited to two demethanizers. For example, a PROD may be omitted if a reboiler (not shown) is used in the bottom of the lean oil absorber 116 (sometimes referred to as a "reboiled absorber") to reject a portion of the methane in the rich lean oil in the bottom of the absorber 116. A methane enriched stream 18 is withdrawn from absorber 116 as a product stream while rich oil containing $C_{2+}$ is withdrawn from the bottom of the absorber 116 as stream 20. Stream 20 is boosted in pressure by pump 118 and passed to primary rich oil demethanizer 120. Demethanizer 120 operates under conditions that produce a methane enriched overhead vapor stream 26, which is recycled by being combined with vapor stream 12 before being introduced to the separator 114. A portion of the rich oil at the lower end of primary rich oil demethanizer 120 is withdrawn and heated in heat exchanger 119 against lean oil stream 100. Rich oil from the bottom of primary rich oil demethanizer 120 can be depressurized and cooled by a liquid expander 122, such as a turbo-expander, and passed as stream 30 to rich oil demethanizer 124. A reboiler side stream 36 is withdrawn from rich oil demethanizer 124 and cross-exchanged in heat exchanger 126 with liquid stream 34 exiting the bottom of rich oil demethanizer 124. Lean oil stream 50 is introduced into the upper portion of rich oil demethanizer 124 in order to reabsorb $C_{2+}$ components that are flashed up demethanizer 124 by reboilers (not shown). It would be understood by those skilled in the art that primary rich oil demethanizer 120 and rich oil demethanizer 124 would have conventional reboilers, which are not shown in the drawings for the sake of simplicity. A methane rich overhead stream 32 is passed to accumulator 130 where it is used to presaturate lean oil stream 42 with methane. Mixed stream 44 may optionally be trim-chilled using any cooling means 129 such as a conventional propane closed-loop chiller or by indirect cooling against PLNG feed stream 10. A methane-rich vapor stream 46 exits the accumulator 130 for any suitable use such as a source of fuel for providing power required for the separation process. Also exiting the accumulator 130 is a liquid lean oil stream 48 which is separated into two lean oil streams 50 and 52 and boosted in pressure by pumps 132 and 134, respectively.

Rich oil stream 34 is passed through heat exchanger 126 and passed through liquid expander 140, which cools and decreases the pressure of the rich oil. Regulator valves 138 and 136 are used to regulate flow of rich oil stream 34 into flash tank 150. For operational reasons, regulator valve 136, normally in the open position, can be closed and regulator valve 138, normally in the closed position, can be opened to allow rich oil to bypass expander 140. Flash tank 150 operates under conditions to cause the rich oil to separate into an overhead vapor stream 62 enriched in $C_{2+}$, primarily $C_2$ to $C_4$ components, and a liquid stream 64 enriched in lean oil. The liquid stream 64 is passed through heat exchanger 152 wherein it is heated. Liquid stream 72 exiting heat exchanger 152 is passed through regulator valve 153 and is passed into still 156. Overhead vapor stream 62 from the flash tank 150 is passed through a regulator valve 154 and then introduced into still 156. Still 156 fractionates the rich oil into an overhead vapor stream 67 enriched in ethane and heavier hydrocarbons contained in the rich oil and a liquid bottoms stream 70 that is enriched in lean oil. Lean oil stream 70 is boosted in pressure by pump 158 and passed through heat exchanger 152 wherein the lean oil is cooled by heat exchange against the liquid stream 64. From heat exchanger 152, the lean oil (stream 98) is further cooled by cooler 160. Stream 99 exiting cooler 160 is combined with stream 94 and passed to heat exchanger 119 to provide reboiling duty. Stream 100 exiting heat exchanger 119 is passed to heat-exchange means 112 to provide the heat needed to vaporize at least part of PLNG stream 12, so that the feed to absorber 116 is at the desired cold temperature for the absorption process. Heat-exchange means 112 thereby also provides refrigeration duty for the lean oil used in the separation process. At least a portion of cooled lean oil stream 101 is recycled by being combined with stream 32 and passed to accumulator 130. A portion of stream 101 is preferably withdrawn from stream 101 as stream 86 and passed through heat exchanger 162 which provides cooling for vapor stream 67 exiting still 156. Lean oil stream 92 exiting heat exchanger 162 is cooled by cooler 164 and boosted in pressure by pump 166 to approximately the same pressure as stream 99. Lean oil make-up stream 97 can introduce lean oil to the separation process that will inevitably be lost during operations since the methane rich stream 18 and $C_{2+}$ product stream 80 produced by the separation process will contain small amounts of lean oil.

Overhead vapor stream 67 is cooled in heat exchanger 162 and passed to an accumulator 168. A vapor stream 80 rich in $C_{2+}$ hydrocarbons is removed from the top of accumulator 168 as a product stream 80 and a liquid stream 78 are removed from the accumulator, pressure enhanced by pump 170, and a portion thereof is recycled as stream 82, passed through control valve 172, and returned to the top of the distillation column 156. A portion of the liquid stream 78 may be removed from the process as liquid petroleum gas (LPG) product stream 79.

The lean oil composition can be easily tailored by persons skilled in the art to avoid components that could potentially freeze up in the PLNG heat-exchange means 112. In addition, the temperature of the PLNG stream 12 being vaporized can be adjusted using modified open rack vaporizers to preclude the freezing out of lean oil components. In addition, indirect heating/cooling systems can be employed to eliminate freezing of lean oil components in the process using an indirect heat exchange system, non-limiting examples of which are illustrated in FIGS. 2 and 3.

Figure 2:
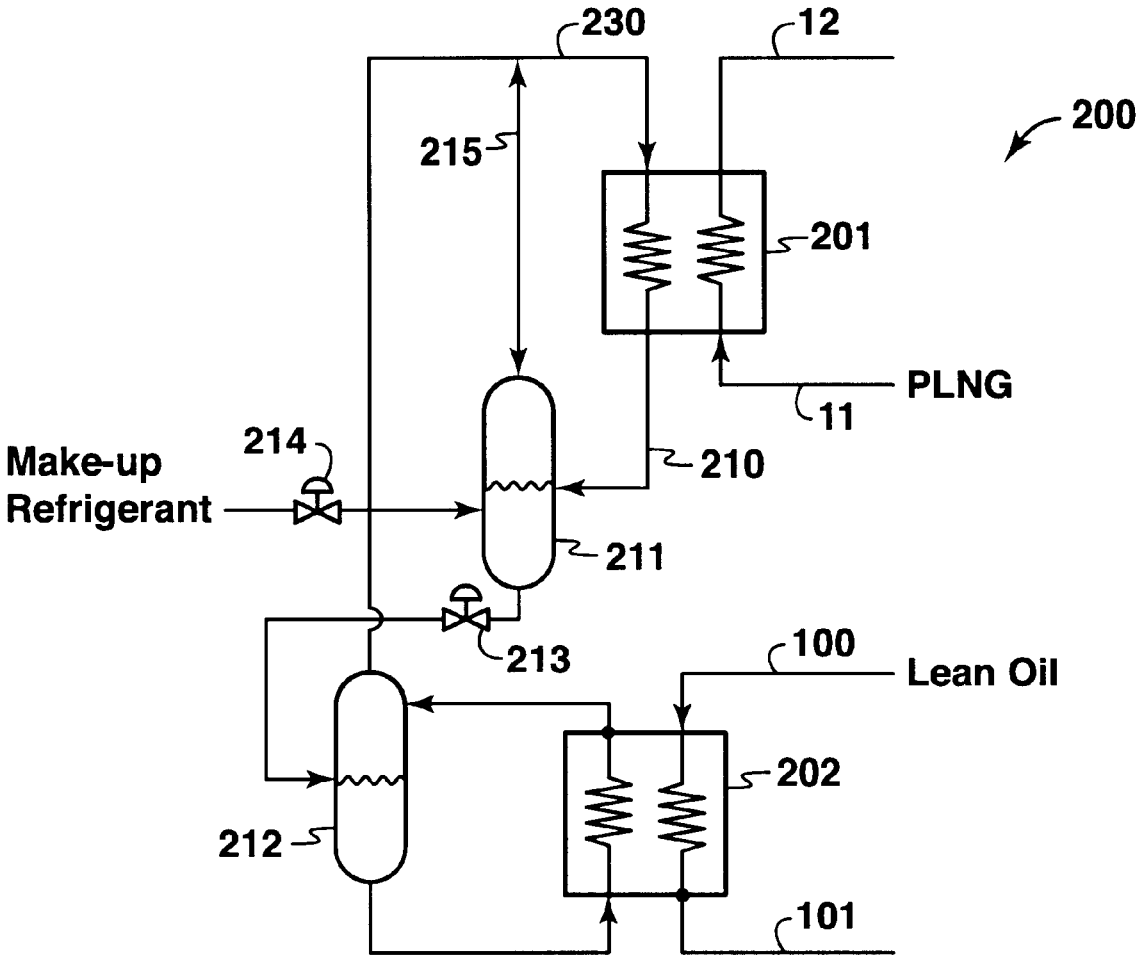
FIG. 2 is a schematic flow diagram of one embodiment of an indirect heat exchange means for vaporizing PLNG using the heat of lean oil used in a separation process for removing ethane and heavier components from PLNG.
Figure 3:
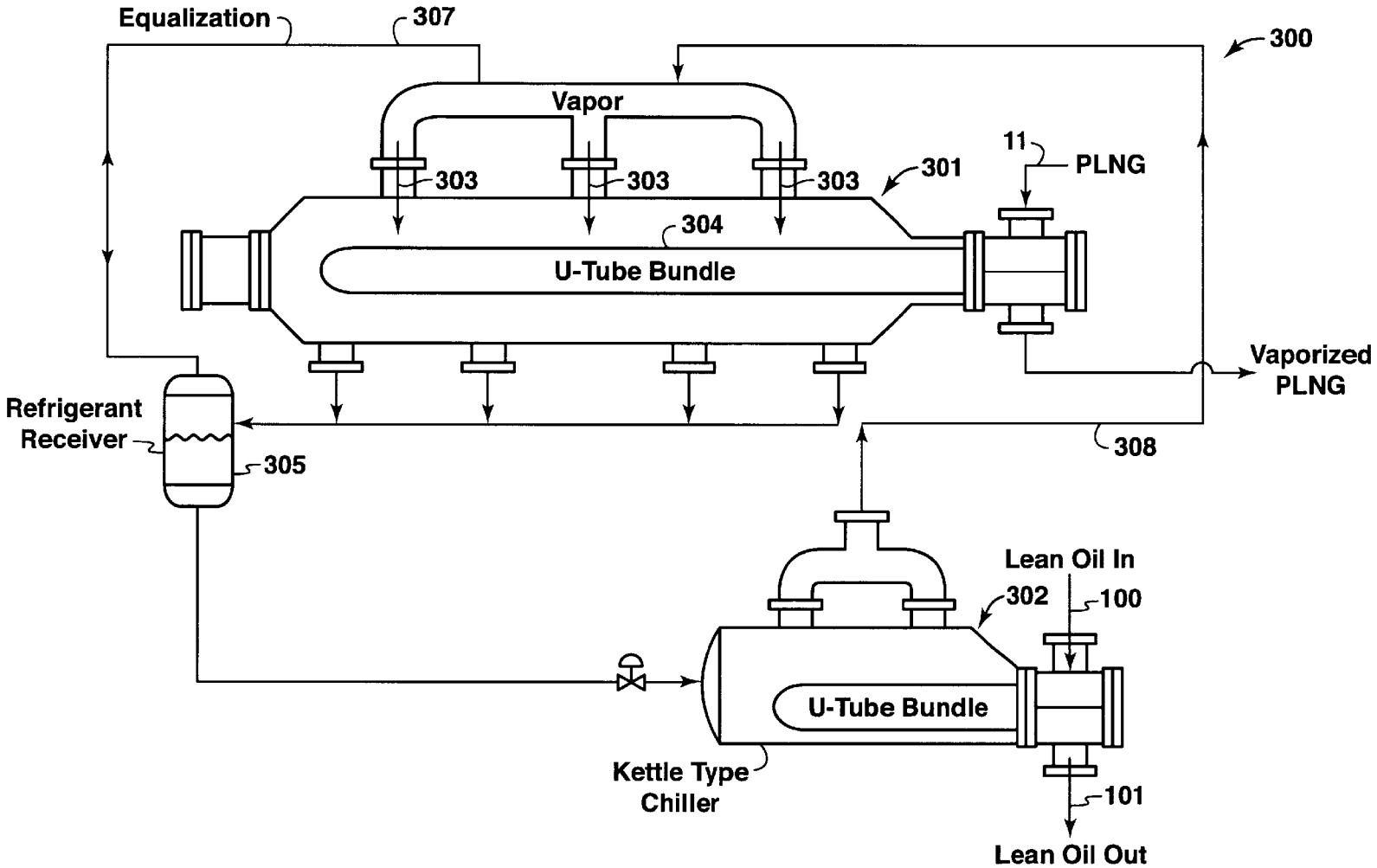
FIG. 3 is a schematic flow diagram of a second embodiment of an indirect heat exchange means for vaporizing PLNG using the heat of lean oil used in a separation process for removing ethane and heavier components from PLNG.

FIG. 2 illustrates a schematic flow diagram of an alternative embodiment of a heat exchange system for vaporizing PLNG stream 11 using the heat of lean oil that is used in the separation process for absorbing $C_{2+}$ from methane. The heat exchange system 200 of FIG. 2 can replace the heat-exchange means 112 of FIG. 1. Referring to FIG. 2, PLNG stream 11 is passed through heat exchanger 201 wherein the PLNG is heated by a closed-loop heat exchange medium that circulates between heat exchanger 201 and heat exchanger 202. The heat exchange medium (stream 200) is cooled as it passes through heat exchanger 201 and it is passed as stream 210 to accumulator 211. Liquid heat exchange medium is withdrawn from the bottom of accumulator 211 and passed to a second accumulator 212. Liquid heat exchange medium is withdrawn from accumulator 212 and passed through heat exchanger 202 wherein the heat exchange medium cools lean oil 100 as it passes through heat exchanger 202. The warmed heat exchange medium exiting heat exchanger 202 is passed back to accumulator 212 and vapor overhead from accumulator 212 is withdrawn and recycled through heat exchanger 201 for recooling and condensing. The vertical movement of refrigerant through heat exchanger 202 occurs as a result of vaporization of the refrigerant and the subsequent reduction in bulk density of the fluid in the heat exchanger, a process sometimes called "thermosiphoning." The refrigerant level in accumulator 212 provides the driving force for maintaining refrigerant flow into the bottom of exchanger 202, and the partial vaporization of the refrigerant in the exchanger lifts the refrigerant out of the exchanger and back into accumulator 212. Unvaporized liquid refrigerant falls into the lower half of accumulator 212, and the vaporized portion of the refrigerant stream flows out the top of accumulator 212 and into the top of exchanger 201. In exchanger 201, the refrigerant vapor stream 210 is liquefied again by cooling against PLNG stream 12. The reliquefied refrigerant flows by gravity back into accumulator 211. Level control valve 213 can be opened as necessary to maintain the desired level in accumulator 212. A low level override valve 213 in liquid line connecting accumulator 211 and accumulator 212 prevents the level in accumulator 211 from falling to an undesirable level. Before it becomes necessary to override and close valve 213, accumulator 211 can open 214 to make up refrigerant from any suitable source. Liquid in accumulator vessel 211 traps out the refrigerant vapor flowing from accumulator 212 and forces it to flow into exchanger 201 the refrigerant vapor is condensed. Persons skilled in the art will recognize that the relative elevation of the two vessels 211 and 212 and the two heat exchangers 201 and 202 would be important to ensure proper hydraulics of the process.

The heat-transfer medium that may be used in the heat exchange system of FIG. 2 is preferably in liquid form during its circulation through heat exchangers 201 and 202 to provide a transfer of both sensible heat and latent heat alternately to and from the heat-transfer medium. It is also preferable that a heat-transfer medium be used that goes through at least partial phase changes during circulation through heat exchangers 201 and 202, with a resulting transfer of latent heat.

The preferred heat-transfer medium, in order to have a phase change, is preferably liquefiable at a temperature above the boiling temperature of the PLNG, such that the heat-transfer medium will be condensed during passage through heat exchanger 201. The heat-transfer medium can be a pure compound or a mixture of compounds of such composition that the heat-transfer medium will condense over a range of temperatures above the vaporizing temperature range of the PLNG.

Although commercial refrigerants may be used as heat-transfer mediums in heat exchange system 200, hydrocarbons having 1 to 6 carbon atoms per molecule, including propane, ethylene, ethane, and methane, and mixtures thereof, are preferred heat-transfer mediums, particularly since they are normally present in at least minor amounts in natural gas and therefore are readily available.

FIG. 3 illustrates a schematic flow diagram of still another embodiment of a heat exchange system for vaporizing at least a portion of the PLNG using the heat of lean oil that is used in the system. The heat exchange system 300 of FIG. 3 can replace the heat-exchange means 112 of FIG. 1. In FIG. 3, PLNG stream 11 is passed through a conventional u-tube heat exchanger 301. A heat-transfer medium is circulated in a closed-loop cycle between heat exchanger 301 and heat exchanger 302. Vaporized heat-transfer medium (represented by arrows 303) is introduced into the u-tube bundle of heat exchanger 301. The heat-transfer medium heats the PLNG that is circulated in the u-tube bundle 304. The heat-transfer medium exiting the heat exchanger 301 is passed to an accumulator 305. Overhead vapor is withdrawn from accumulator 305 and is recycled as stream 307 to the heat exchanger 301. Liquid heat-transfer medium is withdrawn from the bottom of accumulator 305, passed to kettle-type heat exchanger 302. The liquid heat-transfer medium in heat exchanger 302 cools the lean oil 100, thereby vaporizing the heat-transfer medium. The vaporized heat-transfer medium is recycled as stream 308 back to heat exchanger 301 for re-cooling. The heat-transfer medium in heat exchange system 300 may be the same as that used in heat exchange system 200 described previously with respect to the embodiment shown in FIG. 2.

EXAMPLE

A simulated mass and energy balance was carried out to illustrate one embodiment of the invention as described by FIG. 1, and the results are set forth in Table 1 and Table 2 below. The data in the Tables were obtained using a commercially available process simulation program called HYSYS™, version 1.5 (available from Hyprotech Ltd. of Calgary, Canada). However, other commercially available process simulation programs can be used to develop the data, including for example HYSIM™, PROII™, and ASPEN PLUS™, which are familiar to persons skilled in the art. The data presented in Tables 1 and 2 are offered to provide a better understanding of the present invention, but the invention is not to be construed as unnecessarily limited thereto. The temperatures, pressures, and flow rates are not to be considered as limitations of the invention which can have many variations in temperatures, pressures, and flow rates in view of the teachings herein. It is within the expertise of those skilled in the art to choose proper operating conditions for the absorber 116, demethanizers 120 and 124, flash tank 150 and still 156 for a given flow rate, temperature, and composition of a feed stream to the separation process.

One of the benefits of practicing the method of the present invention is that the refrigeration inherent in a PLNG stream can be recovered by modifying a conventional lean oil plant design (including existing plants) to enable the lean oil plant to recover $C_{2+}$ hydrocarbons (LPG products) from the PLNG stream. The refrigeration recovered from the PLNG stream can be utilized in the lean oil process to substantially reduce, and potentially eliminate, the need for an external refrigeration system, such as propane cooler. Another advantage of the present invention is that the vaporization of the PLNG stream can be accomplished by the lean oil process with minimal pressure loss using relatively low cost pump horsepower. Therefore, there are minimal recompression requirements associated with the process of the present invention.

TABLE 1

| Stream # (FIG. 1) | Temperature (° C.) | Pressure (bar) | Molar Flow (kg mole/h) |
|---|---|---|---|
| 10 | −95.56 | 23.39 | 39,720. |
| 11 | −89.28 | 79.29 | 39,720. |
| 12 | −63.89 | 78.46 | 39,720. |
| 13 | −63.89 | 78.46 | 23,830. |
| 14 | −8.30 | 78.46 | 15,890. |
| 16 | −42.80 | 70.64 | 56,300. |
| 17 | 0 | 0 | 0 |
| 18 | −28.26 | 69.84 | 31,880. |
| 20 | −40.94 | 70.33 | 30,360. |
| 24 | −40.75 | 72.39 | 30,360. |
| 26 | −40.18 | 71.71 | 16,580. |
| 28 | 37.78 | 72.05 | 13,770. |
| 30 | 20.67 | 36.20 | 13,770. |
| 32 | −42.12 | 34.47 | 4,403. |
| 34 | 72.03 | 34.96 | 15,010. |
| 42 | −45.56 | 34.89 | 8,072. |
| 44 | −45.56 | 33.65 | 12,480. |
| 46 | −45.56 | 33.65 | 980.8 |
| 48 | −45.56 | 33.65 | 11,490. |
| 50 | −45.49 | 35.51 | 5,638. |
| 52 | −44.24 | 72.39 | 5,857. |
| 54 | 51.33 | 34.27 | 15,010. |
| 58 | 46.55 | 22.75 | 15,010. |
| 62 | 46.55 | 22.75 | 1,230. |
| 64 | 46.55 | 22.75 | 13,780. |
| 66 | 39.59 | 15.86 | 1,230. |
| 67 | 75.69 | 15.17 | 8,659. |
| 69 | −1.111 | 14.89 | 8,659. |
| 70 | 199.7 | 15.65 | 8,072. |
| 72 | 121.1 | 21.93 | 13,780. |
| 74 | 116.6 | 15.86 | 13,780. |
| 78 | −1.111 | 14.89 | 1,722. |
| 80 | −1.111 | 14.89 | 6,938. |
| 82 | −0.5449 | 22.75 | 1,722. |
| 84 | −0.4745 | 19.99 | 1,722. |
| 86 | −45.56 | 34.89 | 3,802. |
| 92 | 52.20 | 34.06 | 3,802. |
| 93 | 48.89 | 33.72 | 3,802. |
| 94 | 49.07 | 37.58 | 3,802. |
| 96 | 203.6 | 41.37 | 8,072. |
| 98 | 100.2 | 40.54 | 8,072. |
| 99 | 48.89 | 36.75 | 8,072. |
| 100 | 48.96 | 36.75 | 11,870. |
| 101 | −45.56 | 34.89 | 11,870. |

TABLE 2

| | Streams # corresponding to Fig. 1 (Mole Fractions) | | | | | | | |
|---|---|---|---|---|---|---|---|---|
| Components | 10 | 24 | 32 | 50 | 52 | 69 | 80 | 100 |
| Methane | 0.7976 | 0.5624 | 0.9760 | 0.2897 | 0.2897 | 0.0126 | 0.0153 | 0.0000 |
| Ethane | 0.1994 | 0.3038 | 0.0187 | 0.0345 | 0.0342 | 0.9140 | 0.9774 | 0.0400 |
| Propane | 0.0001 | 0.0002 | 0.0000 | 0.0001 | 0.0001 | 0.0007 | 0.0005 | 0.0001 |
| i-Butane | 0.0001 | 0.0002 | 0.0000 | 0.0002 | 0.0002 | 0.0011 | 0.0005 | 0.0003 |
| n-Butane | 0.0001 | 0.0002 | 0.0000 | 0.0003 | 0.0003 | 0.0014 | 0.0005 | 0.0004 |
| n-Hexane | 0.0000 | 0.0015 | 0.0000 | 0.0077 | 0.0070 | 0.0276 | 0.0013 | 0.0100 |
| n-Heptane | 0.0000 | 0.0472 | 0.0000 | 0.2423 | 0.2430 | 0.0006 | 0.0000 | 0.3461 |
| n-Octane | 0.0000 | 0.0008 | 0.0000 | 0.0041 | 0.0041 | 0.0000 | 0.0000 | 0.0058 |
| C6p* | 0.0000 | 0.0000 | 0.0000 | 0.0001 | 0.0001 | 0.0003 | 0.0000 | 0.0001 |
| C7p* | 0.0000 | 0.0803 | 0.0001 | 0.4128 | 0.4130 | 0.0385 | 0.0009 | 0.5881 |
| C8p* | 0.0000 | 0.0016 | 0.0000 | 0.0063 | 0.0063 | 0.0000 | 0.0000 | 0.0090 |
| Nitrogen | 0.0014 | 0.0018 | 0.0051 | 0.0019 | 0.0019 | 0.0031 | 0.0035 | 0.0000 |
| $CO_2$ | 0.0013 | 0.0000 | 0.0000 | 0.0000 | 0.0000 | 0.0000 | 0.0000 | 0.0000 |

A person skilled in the art, particularly one having the benefit of the teachings of this patent, will recognize many modifications and variations to the specific process disclosed above. For example, a variety of temperatures and pressures may be used in accordance with the invention, depending on the overall design of the system and the composition, temperature, and pressure of the liquefied natural gas, and the PLNG being fed to a separation system of the present invention can provide cooling for other fluid streams used in the separation process in addition to cooling lean oil stream 100 as illustrated in the process depicted in FIG. 1. As discussed above, the specifically disclosed embodiments and examples should not be used to limit or restrict the scope of the invention, which is to be determined by the claims below and their equivalents.

We claim:

1. An absorption method for recovery of $C_{2+}$ components from a pressurized liquid mixture containing $C_1$ and $C_{2+}$, comprising:

(a) vaporizing at least part of the pressurized liquid mixture by heating the pressurized liquid mixture in a heat transfer means, said heat transfer means cooling an absorption medium; and (b) treating the vaporized stream in an absorption zone with the absorption medium to produce a first stream enriched in $C_1$ and a second stream enriched in $C_{2+}$ components.

2. The method of claim 1 wherein the pressurized liquid mixture is pressurized liquid natural gas (PLNG).

3. The method of claim 1 wherein the pressurized liquid mixture has an initial pressure above about 1,724 kPa (250 psia) and an initial temperature between about −80° C. (−112° F.) and −112° C. (−170° F.).

4. The method of claim 1 wherein the absorption medium is lean oil.

5. The method of claim 1 wherein the absorption medium is pre-saturated with methane prior to treatment step (b).

6. The method of claim 1 wherein the heat exchange relationship uses a heat-transfer medium being in heat exchange relationship with the liquid mixture in a first heat exchanger and the heat transfer medium being in heat exchange relationship with the absorption stream in a second heat exchanger.

7. The method of claim 1 wherein the heat exchange relationship uses at least one heat exchanger in which the liquid mixture is in indirect contact with the absorption medium.

8. The method of claim 1 further comprises, before passing the pressurized liquid mixture in heat exchange relationship with a heat-transfer stream, heating the liquid mixture by heat exchange relationship with at least one of air, fresh water, and sea water.

9. The method of claim 1 further comprises, after passing the pressurized liquid mixture in heat exchange relationship with a heat-transfer stream, further heating the liquid mixture by heat exchange relationship with at least one of air, fresh water, and sea water.

10. A method for separating $C_{2+}$ components from a pressurized liquid mixture comprising $C_1$ and $C_{2+}$, the method comprising:

(a) heating the pressurized liquid mixture to at least partially vaporize the liquid mixture, thereby producing a vapor stream;

(b) contacting the vapor stream with an absorbent medium that preferentially absorbs $C_{2+}$ components from the vapor stream;

(c) recovering a $C_1$-rich stream substantially depleted of $C_{2+}$;

(d) separating the extracted $C_{2+}$ components from the absorption medium containing the same;

(e) cooling at least part of the absorption medium by heat exchange relationship against the pressurized liquid mixture, thereby providing heat for at least partially vaporizing the liquid mixture; and (f) recycling the cooled absorption medium to absorb additional amounts of $C_{2+}$ components.

* * * * *